US010893717B2

(12) United States Patent
Pomering

(10) Patent No.: US 10,893,717 B2
(45) Date of Patent: Jan. 19, 2021

(54) HELMET

(71) Applicant: MIPS AB, Täby (SE)

(72) Inventor: Amy Louise Pomering, Täby (SE)

(73) Assignee: MIPS AB

( * ) Notice: Subject to any disclaimer, the term of this patent is extended or adjusted under 35 U.S.C. 154(b) by 0 days.

(21) Appl. No.: 16/498,749

(22) PCT Filed: Mar. 19, 2018

(86) PCT No.: PCT/EP2018/056896
§ 371 (c)(1),
(2) Date: Sep. 27, 2019

(87) PCT Pub. No.: WO2018/177791
PCT Pub. Date: Oct. 4, 2018

(65) Prior Publication Data

US 2020/0037690 A1 Feb. 6, 2020

(30) Foreign Application Priority Data

Mar. 29, 2017 (GB) ..... 1705040.2
Dec. 12, 2017 (GB) ..... 1720679.8

(51) Int. Cl.
*A42B 3/06* (2006.01)
*A42B 3/14* (2006.01)

(52) U.S. Cl.
CPC ..... *A42B 3/063* (2013.01); *A42B 3/14* (2013.01); *A42B 3/147* (2013.01)

(58) Field of Classification Search
CPC ..... A42B 3/063; A42B 3/147; A42B 3/14; A42B 3/064; A42B 3/08
See application file for complete search history.

(56) References Cited

U.S. PATENT DOCUMENTS 4,307,471 A * 12/1981 Lovell ..... A42B 3/12 2/411
4,449,275 A * 5/1984 Nava ..... A42B 3/08 24/265 EC (Continued)

FOREIGN PATENT DOCUMENTS

EP 3 481 244 B1 9/2019
WO 2010/040127 A2 4/2010

(Continued)

OTHER PUBLICATIONS

Communication under Rule 71(3) EPC, Intention to Grant, European Application No. 18 712 859.0 (now European Patent No. 3 481 244), 5 pages (dated Jul. 8, 2019).

(Continued)

*Primary Examiner* — Khaled Annis
(74) *Attorney, Agent, or Firm* — Perkins Coie LLP

(57) ABSTRACT

A connector (50) for connecting an inner shell (3) and an outer shell (2) of a helmet (1) so as to allow the inner shell and the outer shell to slide relative to each other, the connector (50) comprising: a first attachment part (51) for attaching to one of the inner shell and the outer shell; a second attachment part (52) for attaching to the other of the inner shell and the outer shell; and one or more resilient structures (53) extending between the first attachment part and the second attachment part and configured to connect the first attachment part and the second attachment part so as to allow the first attachment part to move relative to the second attachment part as the resilient structures deform; wherein the resilient structures comprise at least one angular portion between the first attachment part and the second attachment part, an angle of said angular portion being configured to change to allow relative movement between the first attachment part and the second attachment part.

15 Claims, 16 Drawing Sheets

(56) References Cited

U.S. PATENT DOCUMENTS 5,351,341 A * 10/1994 Broersma ..... A42B 3/066 2/412
5,713,083 A * 2/1998 King ..... A42B 1/02 2/181
5,898,949 A * 5/1999 Barthold ..... A42B 3/14 2/411
2001/0032351 A1* 10/2001 Nakayama ..... A42B 3/064 2/412
2002/0108168 A1* 8/2002 Roy ..... A42B 3/08 2/411
2010/0115686 A1 5/2010 Halldin
2010/0281603 A1* 11/2010 Ho ..... A42B 3/04 2/411
2011/0047685 A1* 3/2011 Ferrara ..... B32B 25/14 2/455
2011/0175416 A1 7/2011 Cohen
2012/0198604 A1* 8/2012 Weber ..... A42B 3/125 2/414
2012/0233745 A1 9/2012 Veazie
2012/0304366 A1* 12/2012 Daoust ..... A42B 3/04 2/411
2013/0042397 A1* 2/2013 Halldin ..... A42B 3/12 2/411
2013/0232668 A1 9/2013 Suddaby
2014/0000012 A1* 1/2014 Mustapha ..... A42B 3/064 2/414
2014/0013491 A1* 1/2014 Hoshizaki ..... A42B 3/12 2/411
2015/0052669 A1 2/2015 Yoon
2015/0059066 A1* 3/2015 Ketterer ..... A42B 3/145 2/418
2015/0113710 A1* 4/2015 Jacobsen ..... A42B 3/08 2/421
2015/0164172 A1* 6/2015 Linares ..... A42B 3/064 2/411
2015/0223547 A1 8/2015 Wibby
2015/0250248 A1* 9/2015 Jacobsen ..... A42B 3/06 2/421
2015/0359285 A1* 12/2015 Rennaker, II ..... A42B 3/064 2/414
2016/0021965 A1* 1/2016 Mayerovitch ..... A42B 3/12 2/414
2016/0135535 A1* 5/2016 Jacobsen ..... A42B 3/08 2/421
2016/0165993 A1 6/2016 Knight
2016/0214332 A1* 7/2016 Zhao ..... A43B 13/026
2016/0242484 A1 8/2016 Morgan
2016/0316847 A1* 11/2016 Weber ..... A42B 3/125
2017/0105470 A1* 4/2017 Eaton ..... A42B 3/064
2017/0196291 A1* 7/2017 Glover ..... A42B 3/125
2017/0196292 A1* 7/2017 Reinhall ..... A42B 3/063
2017/0215507 A1* 8/2017 Straus ..... A42B 3/064
2017/0245578 A1* 8/2017 Xiong ..... A42B 3/085
2018/0000186 A1* 1/2018 Brown ..... A41D 13/05
2018/0132556 A1* 5/2018 Laperriere ..... A42B 3/064
2018/0213874 A1* 8/2018 Lanner ..... A42B 3/064
2018/0228239 A1* 8/2018 Day ..... A42B 3/064

FOREIGN PATENT DOCUMENTS

WO 2016/112225 A1 7/2016
WO 2017/120364 A1 7/2017

OTHER PUBLICATIONS

International Search Report, International Application No. PCT/EP2018/056896 (published under WO 2018/177791 A1), 9 pages (dated Aug. 13, 2018).
International Preliminary Report on Patentability, International Application No. PCT/EP2018/056896 (published under WO 2018/177791 A1), 12 pages (dated Oct. 1, 2019).

* cited by examiner

HELMET

This application is a 371 national phase application of International Application No. PCT/EP2018/056896, filed Mar. 19, 2018, which claims priority to British Application No. 1720679.8, filed Dec. 12, 2017, and British Application No. 1705040.2, filed Mar. 29, 2017, the contents of each of which applications is incorporated herein by reference in its entirety.

The present invention relates to helmets. In particular, the invention relates to helmets in which an inner shell and an outer shell are able to slide relative to each other under an oblique impact, and the connectors between those layers.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets are used in ice hockey, cycling, motorcycling, motor-car racing, skiing, snow-boarding, skating, skateboarding, equestrian activities, American football, baseball, rugby, cricket, lacrosse, climbing, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to, inter alia, the maximum acceleration that may occur in the centre of gravity of the brain at a specified load. Typically, tests are performed, in which what is known as a dummy skull equipped with a helmet is subjected to a radial blow towards the head. This has resulted in modem helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotational energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and more severe traumatic brain injuries such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

Helmets are known in which an inner shell and an outer shell are able to slide relative to each other under an oblique impact to mitigate against injuries caused by angular components of acceleration (e.g. WO 2001/045526 and WO 2011/139224). However, present solutions, often require complex components to allow the helmet shells to remain connected while still allowing sliding. This can make such helmets expensive manufacture. Also, present solutions are typically bulky and take up a large amount of space in the helmet. Further, existing helmets cannot easily be adapted to allow sliding. The present invention aims to at least partially address one ore more of these problems.

An aspect of the invention provides a connector for connecting an inner shell and an outer shell of a helmet, the connector preferably comprising one or more of: a first attachment part for attaching to one of the inner shell and the outer shell; a second attachment part for attaching to the other of the inner shell and the outer shell; and one or more resilient structures extending between the first attachment part and the second attachment part and configured to connect the first attachment part and the second attachment part so as to allow the first attachment part to move relative to the second attachment part as the resilient structures deform; and optionally wherein the resilient structures comprise at least one angular portion between the first attachment part and the second attachment part, an angle of said angular portion being configured to change to allow relative movement between the first attachment part and the second attachment part.

Optionally, the angular portion is substantially V-shaped, the two ends of the V-shape being connected to the first attachment part and the second attachment part respectively.

Optionally, the angular portion is substantially Z-shaped, the two ends of the Z-shape being connected to the first attachment part and the second attachment part respectively.

Another aspect of the invention provides a connector for connecting an inner shell and an outer shell of a helmet, the connector preferably comprising one or more of: a first attachment part for attaching to one of the inner shell and the outer shell; a second attachment part for attaching to the other of the inner shell and the outer shell; and one or more resilient structures extending between the first attachment part and the second attachment part and configured to connect the first attachment part and the second attachment part so as to allow the first attachment part to move relative to the second attachment part as the resilient structures deform; and optionally wherein the resilient structures comprise at least one inflected portion between the first attachment part and the second attachment part, an inflection amount of said inflected portion being configured to change to allow relative movement between the first attachment part and the second attachment part.

Optionally, the inflected portion is substantially S-shaped, the two ends of the S-shape being connected to the first attachment part and the second attachment part respectively.

Another aspect of the invention provides a connector for connecting an inner shell and an outer shell of a helmet, the connector preferably comprising one or more of a first attachment part for attaching to one of the inner shell and the outer shell; a second attachment part for attaching to the other of the inner shell and the outer shell; and one or more resilient structures extending between the first attachment part and the second attachment part and configured to connect the first attachment part and the second attachment part so as to allow the first attachment part to move relative to the second attachment part as the resilient structures deform; and optionally wherein the resilient structures comprise at least one loop-like portion between the first attachment part and the second attachment part, the shape of said loop-like portion being configured to change to allow relative movement between the first attachment part and the second attachment part.

Optionally, the loop-like portion is substantially elliptical, two opposing sides of the ellipse being connected to the first attachment part and the second attachment part respectively.

Another aspect of the invention provides a connector for connecting an inner shell and an outer shell of a helmet, the connector preferably comprising one or more of: a first attachment part for attaching to one of the inner shell and the outer shell; a second attachment part for attaching to the other of the inner shell and the outer shell; and one or more resilient structures extending between the first attachment part and the second attachment part and configured to connect the first attachment part and the second attachment part so as to allow the first attachment part to move relative to the second attachment part as the resilient structures deform; and optionally wherein the resilient structures comprise at least two intersecting parts between the first attachment part and the second attachment part, the angle at which the two intersecting parts intersect being configured to change to allow relative movement between the first attachment part and the second attachment part.

Optionally, the intersecting parts intersect to form a substantially X-shaped portion, a first two ends of the X-shape being connected to the first attachment part and a second two ends of the X-shape being connected to the second attachment part.

Optionally, the intersecting parts intersect to form a substantially Y-shaped portion, two ends of the Y-shape being connected to one of the first attachment part and the second attachment part and the third end of the Y-shape being connected to the other of the first attachment part and the second attachment part.

Another aspect of the invention provides a connector for connecting an inner shell and an outer shell of a helmet, the connector preferably comprising one or more of: a first attachment part for attaching to one of the inner shell and the outer shell; a second attachment part for attaching to the other of the inner shell and the outer shell; and one or more resilient structures extending between the first attachment part and the second attachment part and configured to connect the first attachment part and the second attachment part so as to allow the first attachment part to move relative to the second attachment part as the resilient structures deform; and optionally wherein the resilient structures comprise at least one straight portion between the first attachment part and the second attachment part, the straight portion being configured to bend to allow relative movement between the first attachment part and the second attachment part.

Optionally, the first attachment part and second attachment part are respectively configured to be fixedly attached to one or other of the inner shell and the outer shell.

Optionally, the first attachment part and second attachment part are respectively configured to be fixedly attached to one or other of the inner shell and the outer shell in a direction orthogonal to the extension direction of the one or more resilient structures.

Optionally, the second attachment part comprises a recess configured to accommodate a portion of the inner shell or outer shell to which the second attachment part is to be attached.

Optionally, the second attachment part comprises one or more apertures through which fixing means may pass for fixing the second attachment part to the inner shell or outer shell to which the second attachment part is to be attached.

Optionally, the recess comprises the one or more apertures.

Optionally, the second attachment part is arranged to at least partially surround the first attachment part.

Optionally, the first attachment part comprises a recess configured to accommodate a strap attachment part for attaching a strap to the helmet.

Optionally, the first attachment part comprises one or more apertures through which fixing means may pass for fixing the second attachment part to the inner shell or outer shell to which the first attachment part is to be attached.

Optionally, the recess comprises the one or more apertures, and the one or more apertures are further configured such that fixing means may pass through for fixing the strap attachment part to the first attachment part.

Optionally, the recess of the first attachment part faces in a first direction orthogonal to the extension direction of one or more resilient structures and the recess of the second attachment part faces in a second direction opposite to the first direction.

Optionally, the connector 50 is configured to press fit into the inner and/or outer shell of the helmet.

Optionally, the first attachment part and/or second attachment part are respectively configured to abut one or other of the inner shell and the outer shell.

Optionally, at least two resilient structures are provided having different resiliencies.

Another aspect of the invention provides a connector for connecting an inner shell and an outer shell of a helmet, the connector preferably comprising one or more of: a first attachment part for attaching to one of the inner shell and the outer shell; a second attachment part for attaching to the other of the inner shell and the outer shell and arranged to at least partially surround the first attachment part; and one or more resilient structures extending between the first attachment part and the second attachment part and configured to connect the first attachment part and the second attachment part so as to allow the first attachment part to move relative to the second attachment part as the resilient structures deform; and optionally wherein the first attachment part comprises a recess configured to accommodate a strap attachment part for attaching a strap to the helmet.

Another aspect of the invention provides a helmet, preferably comprising one or more of: an inner shell; an outer shell comprising one or more strap attachment points; a strap comprising a strap attachment part attached to the outer shell at the one or more strap attachment points; a connector comprising: a first attachment part attached to the outer shell; a second attachment part attached to the inner shell; and one or more resilient structures extending between the first attachment part and the second attachment part and configured to connect the first attachment part and the second attachment part so as to allow the first attachment part to move relative to the second attachment part as the resilient structures deform; and optionally wherein the relative movement between the first attachment part and the second attachment part allows sliding between the inner shell and the outer shell of the helmet; and wherein the first attachment part is attached to the outer shell at the one or more strap attachment points.

Another aspect of the invention provides a method of providing sliding between an inner shell of a helmet and an outer shell of a helmet, using a connector, the method preferably comprising one or more of attaching a first attachment part of the connector to the outer shell; attaching a second attachment to the inner shell; and wherein one or more resilient structures extend between the first attachment part and the second attachment part and are configured to connect the first attachment part and the second attachment part so as to allow the first attachment part to move relative to the second attachment part as the resilient structures deform; and optionally wherein the first attachment part is attached to the outer shell at one or more strap attachment points of the outer shell at which a strap is attached to the outer shell; and the relative movement between the first attachment part and the second attachment part allows sliding between the inner shell and the outer shell of the helmet.

The invention is described below by way of non-limiting examples, with reference to the accompanying drawings, in which.

Figure 6:
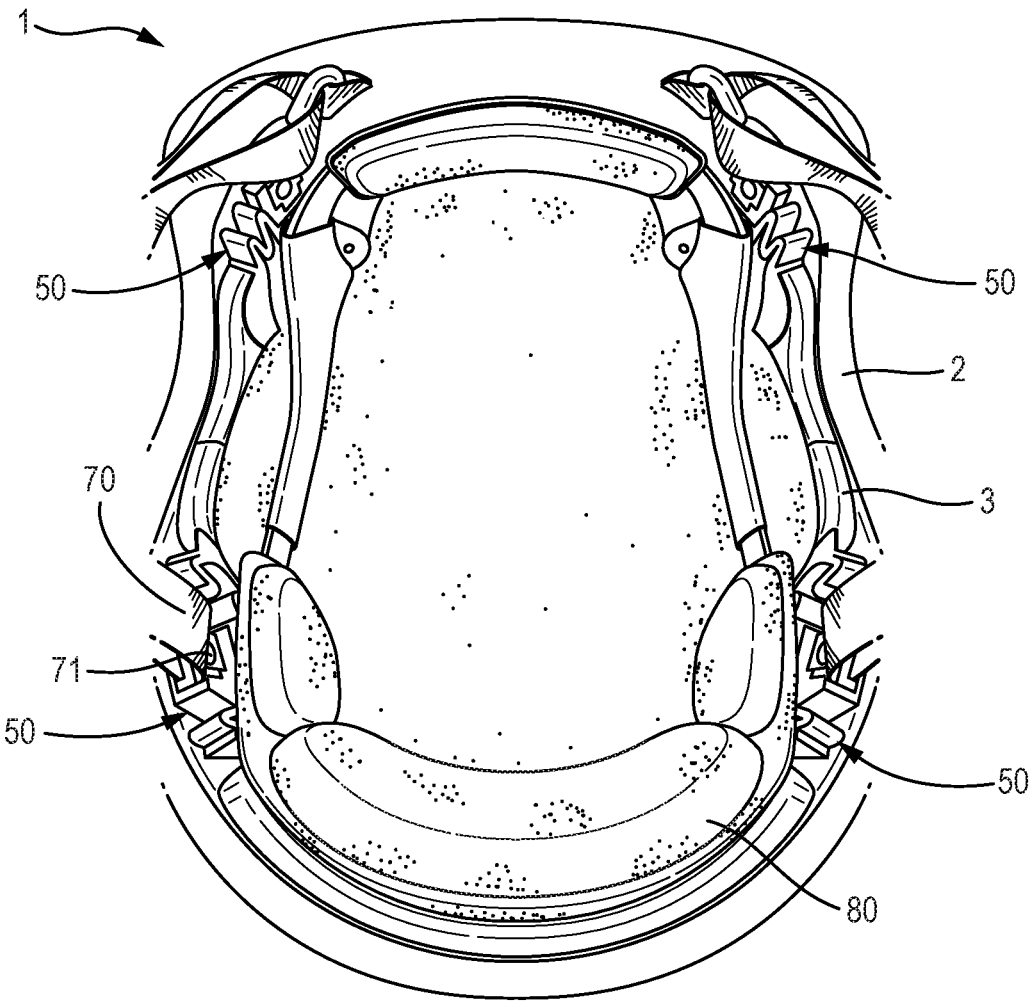
FIG. 6 shows the interior of a helmet comprising connectors in accordance with the invention.
Figure 7:
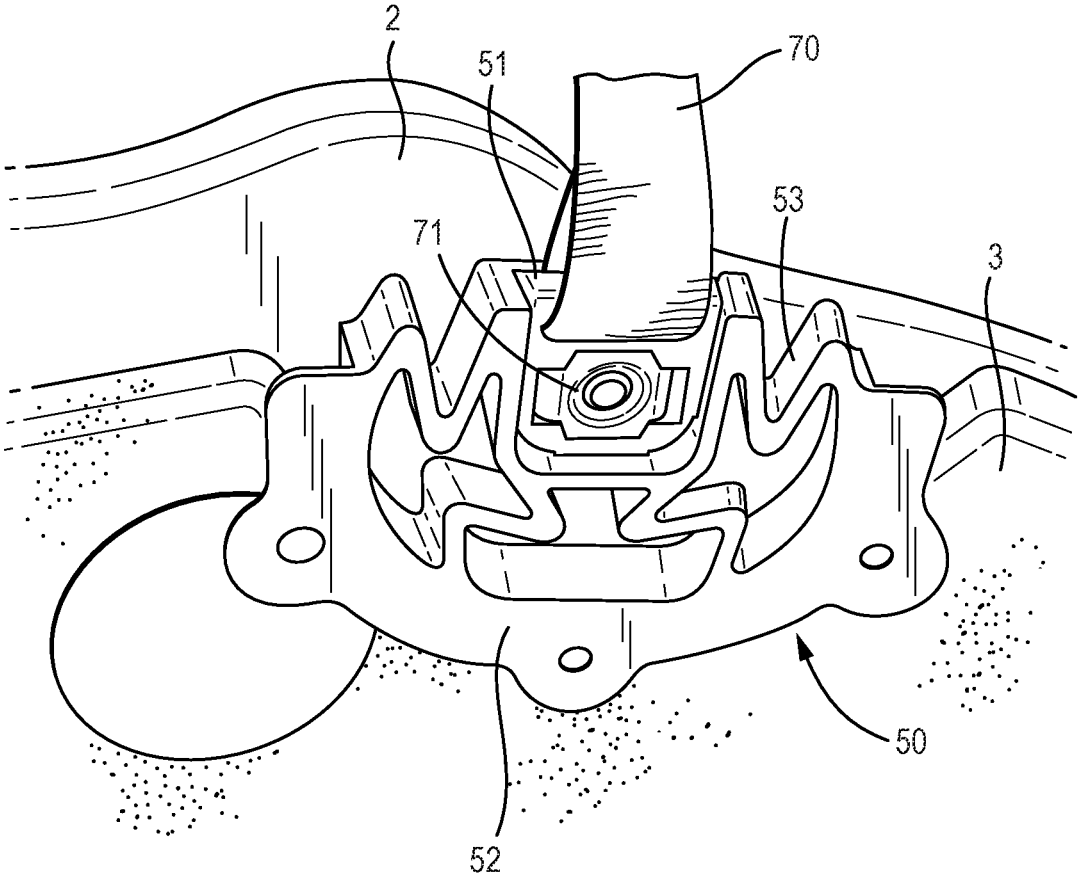
Figure 8:
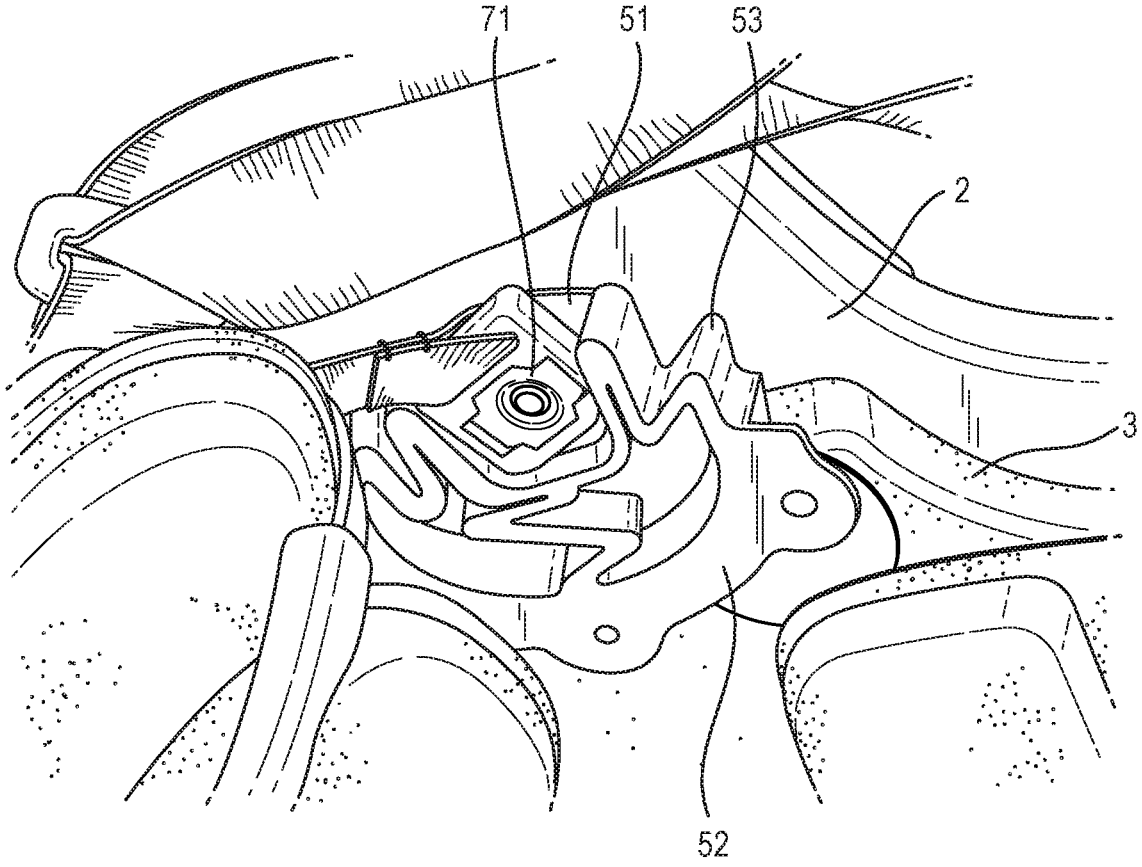
Figure 9:
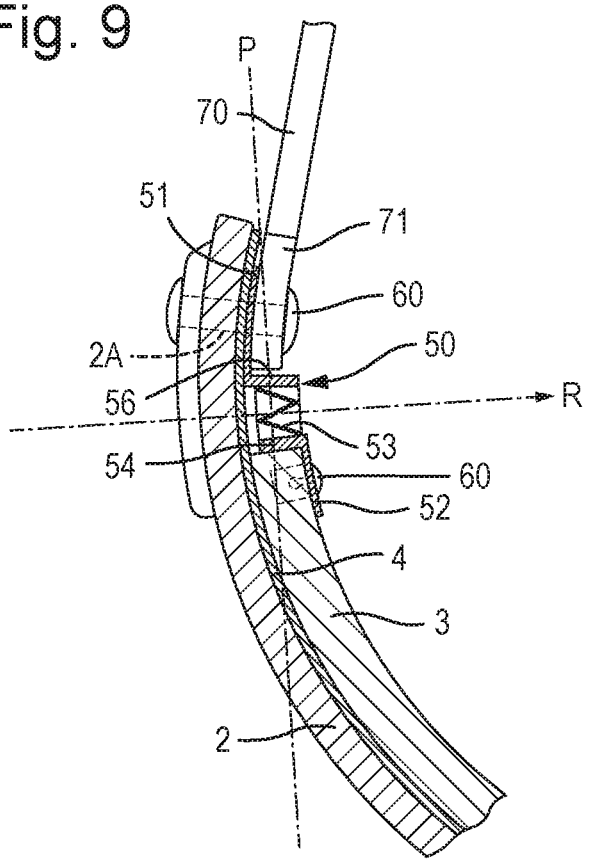
Figure 10:
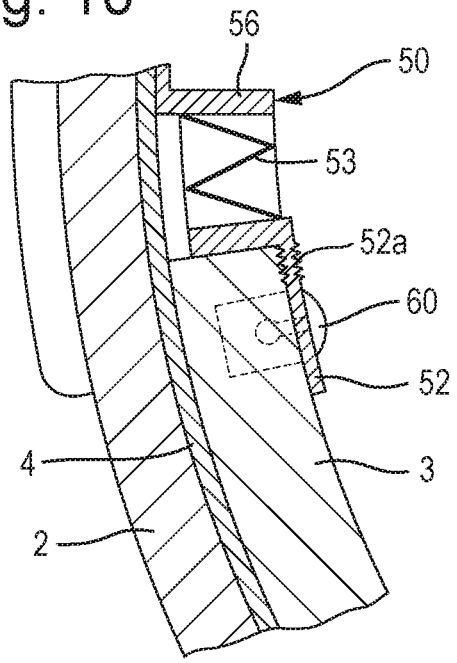
Figure 24:
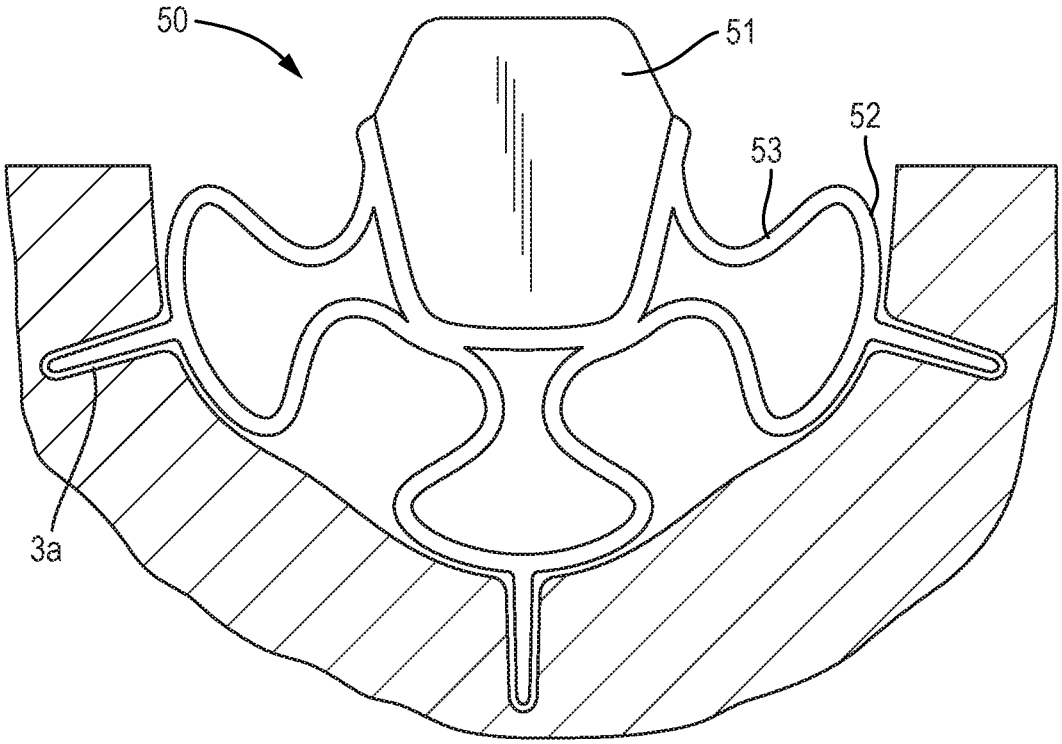
Figure 25:
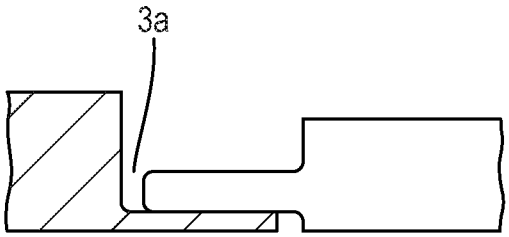
Figure 26:
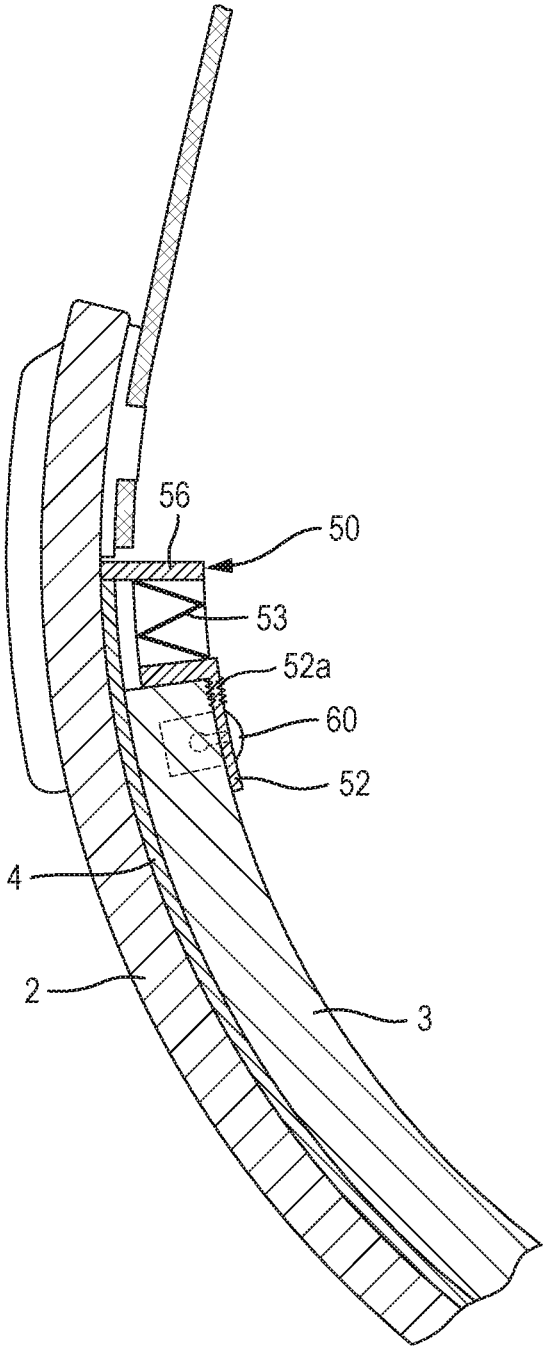

FIGS. 7 and 8 respectively show close up views of front and rear connectors shown in FIG. 6 with the comfort padding removed;

FIG. 9 shows a side view of the connector attached to the helmet;

FIG. 10 shows a side view of another connector attached to the helmet;

FIGS. 11 to 23 show connector arrangements according to different embodiments of the invention;

FIG. 24 shows a further connector connected to the inner shell of a helmet;

FIG. 25 shows a cross-sectional side view of the connector of FIG. 24 connected to the inner shell of the helmet;

FIG. 26 shows a side view of yet another connector attached to the helmet

Figure 27:
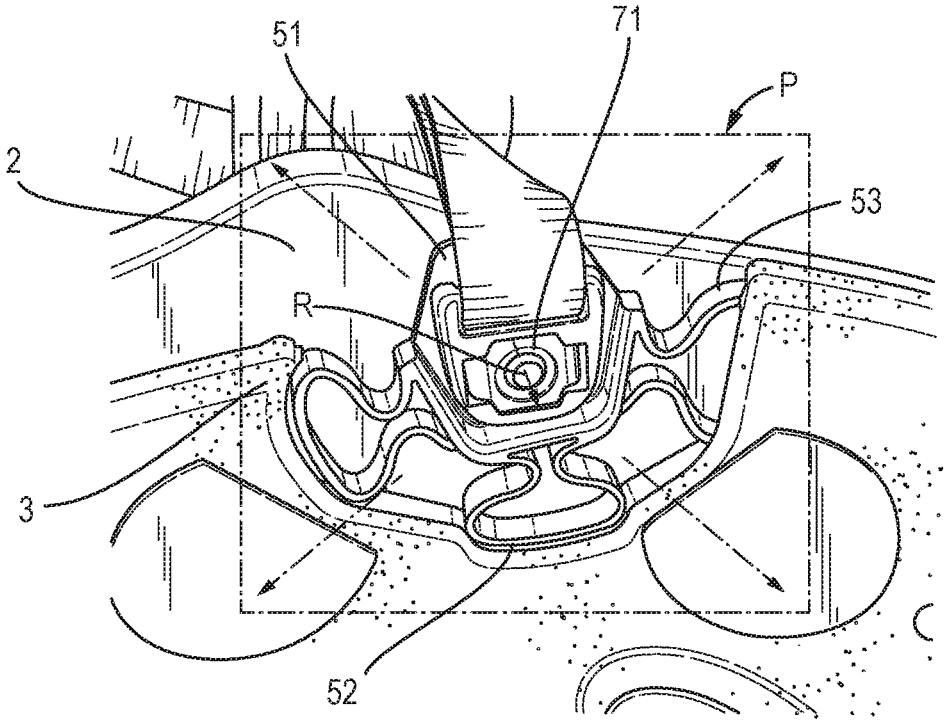
Figure 28:
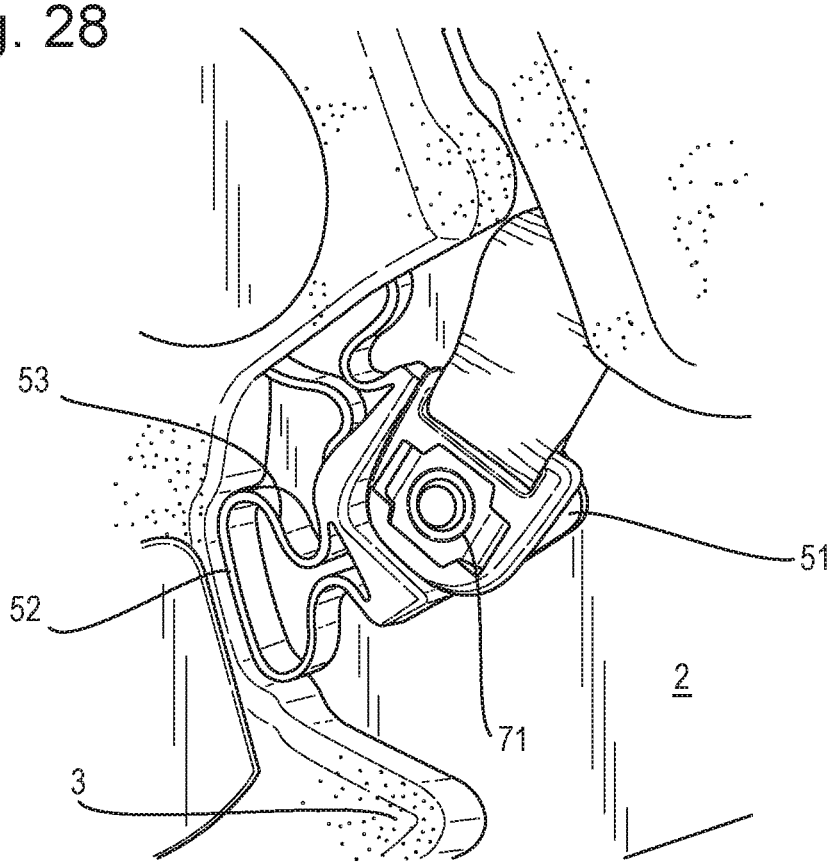
Figure 29:
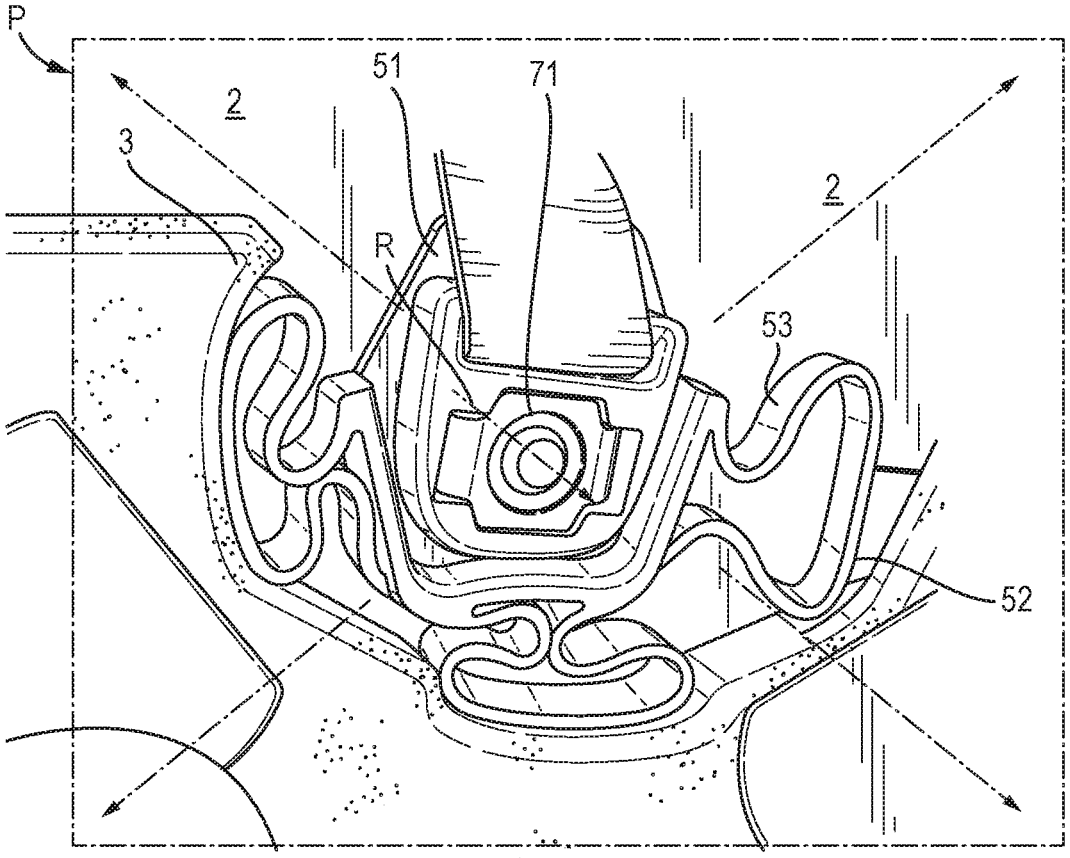

FIG. 27 and FIG. 28 respectively show front and rear connectors in a neutral position;

FIG. 29 shows the connector of FIG. 27 in a deformed position.

The proportions of the thicknesses of the various layers and spacing between the layers in the helmets depicted in the figures have been exaggerated in the drawings for the sake of clarity and can of course be adapted according to need and requirements.

Figure 1:
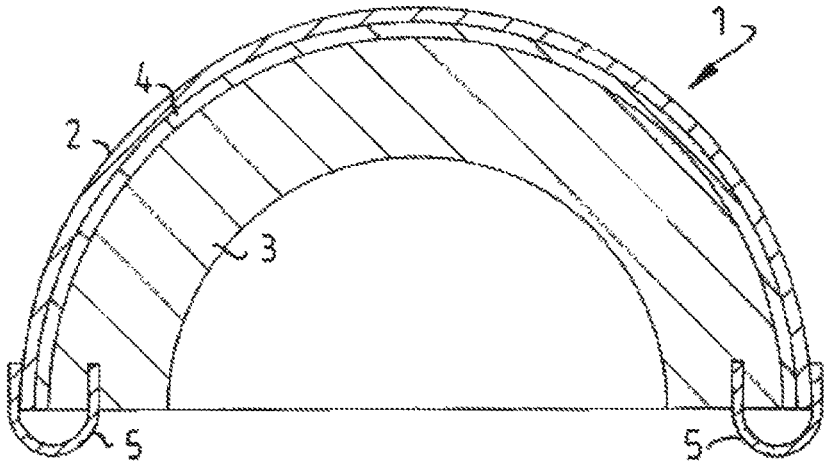
FIG. 1 depicts a cross section through a helmet for providing protection against oblique impacts.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3. An additional attachment device may be provided that is intended for contact with the head of the wearer.

Arranged between the outer shell 2 and the inner shell 3 is an intermediate layer 4 or a sliding facilitator, and thus makes possible displacement between the outer shell 2 and the inner shell 3. In particular, as discussed below, an intermediate layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connecting members 5 may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied. For example, the connecting members may be positioned away from the edge portion, and connect the outer shell 2 and the inner shell 3 through the intermediate layer 4

The outer shell 2 may be relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre, Kevlar or ultrahigh molecular weight polyethylene (UHMWPE).

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the intermediate layer 4 or sliding facilitator, for example oil, gel, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. A layer of low friction plastics material such as PC is preferable for the intermediate layer 4. This may be moulded to the inside surface of the outer shell 2 (or more generally the inside surface of whichever layer it is directly radially inward of), or moulded to the outer surface of the inner shell 3 (or more generally the outside surface of whichever layer it is directly radially outward of). The number of intermediate layers and their positioning can also be varied, and an example of this is discussed below (with reference to FIG. 3B).

As connecting members 5, use can be made of, for example, deformable strips of rubber, plastic or metal. These may be anchored in the outer shell and the inner shell in a suitable manner.

Figure 2:
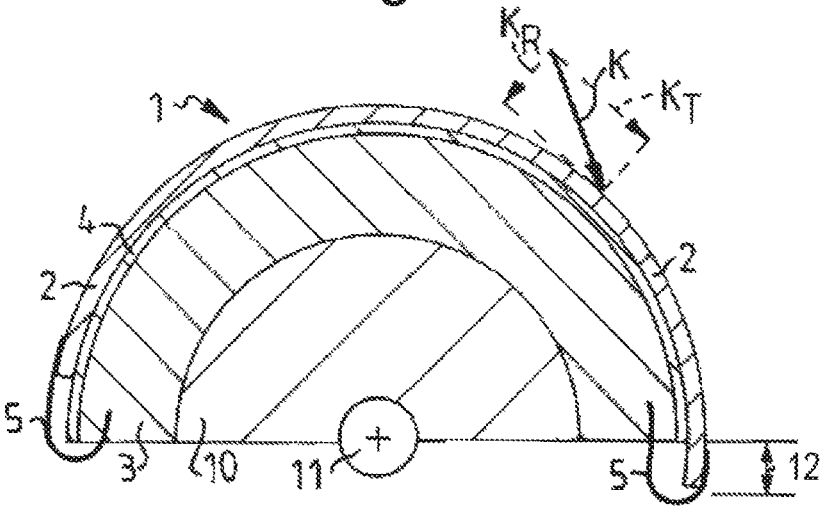
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. A reduction in the torsional force transmitted to the skull 10 of up to around 75%, and on average roughly 25% can be obtained with such an arrangement. This is a result of the sliding motion between the inner shell 3 and the outer shell 2 reducing the amount of rotational energy otherwise transferred to the brain.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3). Although FIG. 2 shows the intermediate layer 4 remaining fixed relative to the inner shell 3 while the outer shell slides, alternatively, the intermediate layer 4 may remain fixed relative to the outer shell 2 while the inner shell 3 slides relative to the intermediate layer 4. Alternatively still, both the outer shell 2 and inner shell 3 may slide relative to the intermediate layer 4.

Figure 3A:
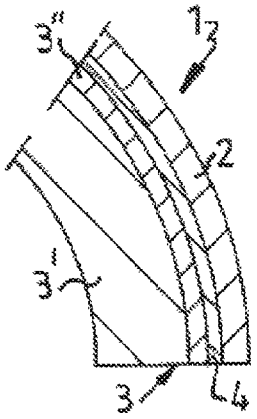
FIGS. 3A, 3B & 3C show variations of the structure of the helmet of FIG. 1.
Figure 3B:
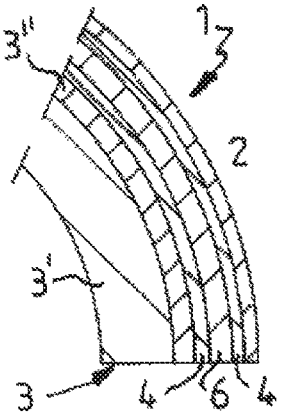
Figure 3C:
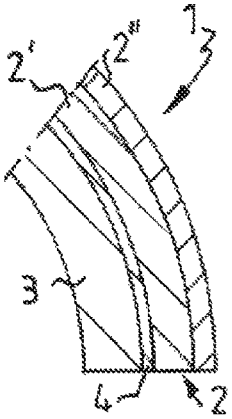

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" may be harder than the inner layer 3', to help facilitate the sliding with respect to outer shell 2. In FIG. 3*b*, the inner shell 3 is constructed in the same manner as in FIG. 3*a*. In this case, however, there are two intermediate layers 4, between which there is an intermediate shell 6. The two intermediate layers 4 can, if so desired, be embodied differently and made of different materials. One possibility, for example, is to have lower friction in the outer intermediate layer than in the inner. In FIG. 3*c*, the outer shell 2 is embodied differently to previously. In this case, a harder outer layer 2" covers a softer inner layer 2'. The inner layer 2' may, for example, be the same material as the inner shell 3. Although, FIGS. 1 to 3 show no separation in a radial direction between the layers, there may be some separation between layers, such that a space is provided, in particular between layers configured to slide relative to each other.

Figure 4:
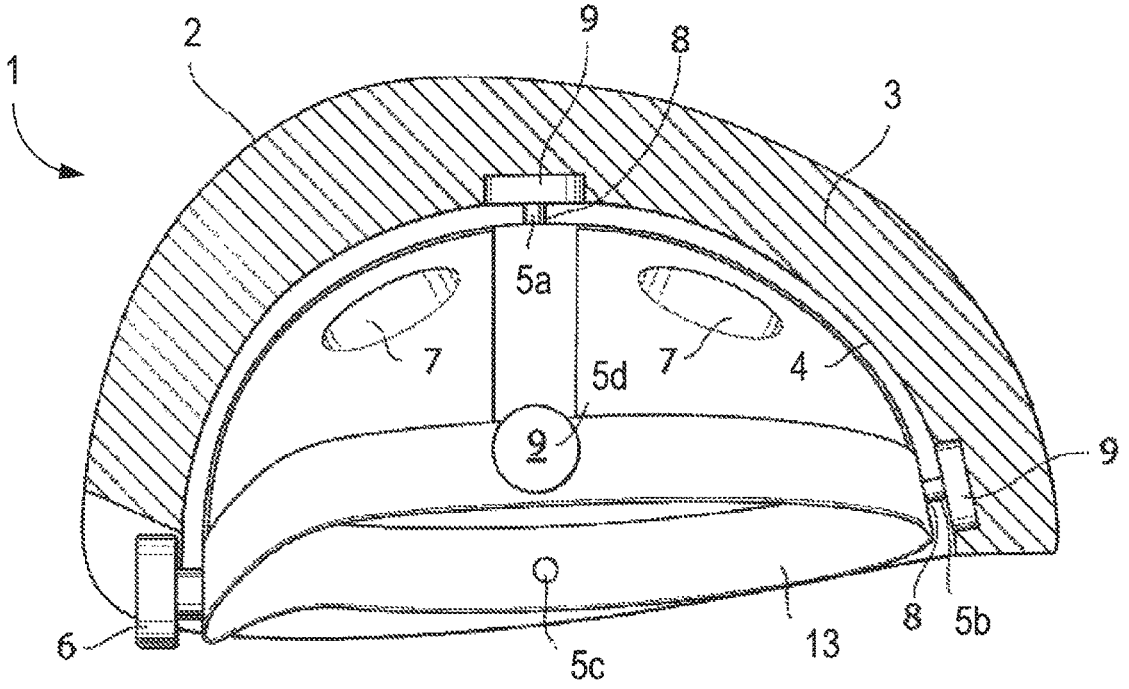
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 5 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, EEP, PE and UHMWPE, or a powder material which could be infused with a lubricant. The low friction material could be a fabric material. As discussed, this low friction material could be applied to either one, or both of the sliding facilitator and the energy absorbing layer The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
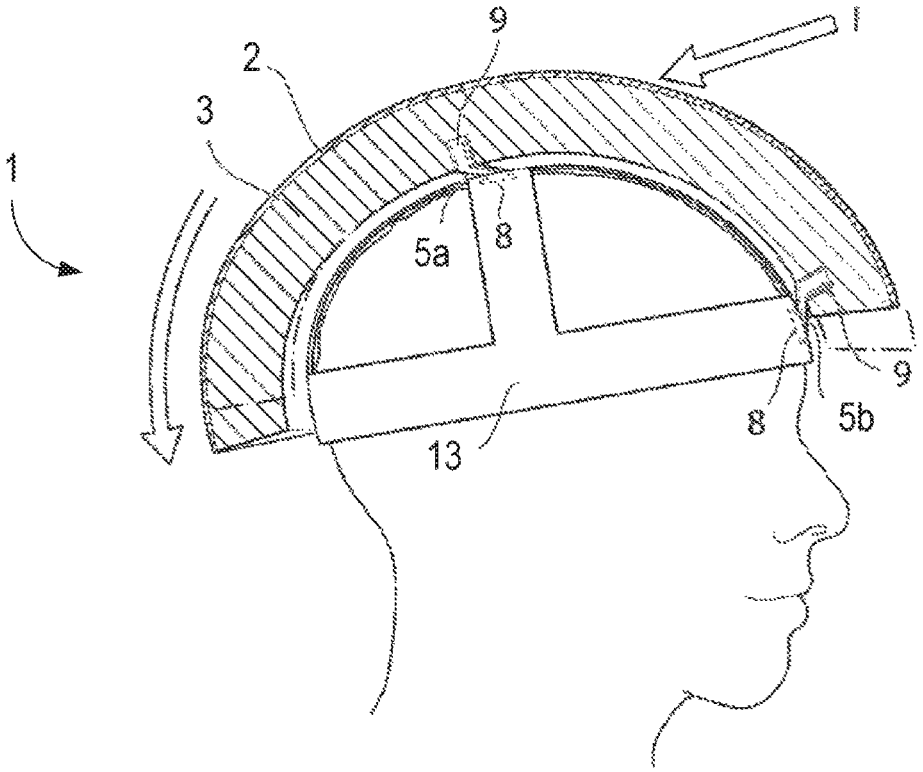
FIG. 5 depicts an alternative way of connecting the attachment device of the helmet of FIG. 4

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members 5 deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and more severe traumatic brain injuries such as subdural haematomas, SDH, blood vessel rapturing, concussions and DAI is thereby reduced.

FIG. 6 shows an example of a helmet 1 according to the present invention. The helmet 1 comprises an inner shell 3 and an outer shell 2. Inside the inner shell 3 is an optional comfort padding layer 80. The outer shell 2 comprises four strap attachment points 2A (in practice any number of strap attachment points 2A may be provided). FIG. 9 more clearly shows a strap attachment point 2A, according to one embodiment. The strap attachment points 2A are configured to be attached to a strap 70 of the helmet 1. The strap 70 comprises a strap attachment part 71 configured to attach the strap 70 to the helmet 1. As shown in FIG. 6 the strap attachment part 71 is attached to the outer shell 2 at the strap attachment points 2A. In other embodiments not shown in the Figure, the strap attachment points 2A may be provided in the inner shell 3 of the helmet, rather than the outer shell 2. In that case, the strap 70 may be attached to the inner shell 3 instead.

The strap 70 may be a strap for securing the helmet 1 to the head of a user, e.g. a chin strap. The strap 70 may be formed substantially from a fabric material. The strap attachment part 71 may be a component formed from a relatively hard material, such as metal, plastic or a composite material. The strap attachment part 71 may comprise an aperture through which a fixing means 60, e.g. a bolt, may pass for attaching the strap 70 to the helmet 1. The strap attachment part 71 may be at an end of the strap 70.

The present invention provides a method of providing sliding between the inner shell 3 and the outer shell 2 of the helmet 1, using a connector 50. Connectors 50, may be used alternatively or additionally to the connecting members 5 described above in relation to the helmets 1 shown in FIGS. 1 to 5. For example, as shown by the helmet in FIG. 6, the connector 50 comprises a first attachment part 51 for attaching to one of the outer shell 2 and the inner shell 3 and a second attachment part 52 for attaching to the other of the outer shell 2 or the inner shell 3. One or more resilient structures 53 extend between the first attachment part 51 and the second attachment part 52 and are configured to connect the first attachment part 51 and the second attachment part 52 so as to allow the first attachment part 51 to move relative to the second attachment part 52 as the resilient structures 53 deform. The relative movement between the first attachment part 51 and the second attachment part 52 allows sliding between the inner shell 3 and the outer shell 2 of the helmet 1.

In the embodiment shown in the Figures, the first attachment part 51 is attached to the outer shell 2 at one of the strap attachment points 2A of the outer shell 2 at which a strap 70 is attached to the outer shell 2. Alternatively, if the strap attachment points may be provided in the inner shell 3, accordingly the first attachment part 51 may be connected to the inner shell 3 at one of the strap attachment points 2A. The connector 50 may be arranged in the opposite way such that the second attachment part 52 is attached to the outer shell 2 or inner shell 3 at one of the strap attachment point 2A. In this way, the present invention makes use of pre-existing strap attachment points for connecting the inner and outer shells 3, 2 of the helmet 1, thus making efficient use of space. Further, this allows the connector 50 to be fitted retrospectively into pre-existing helmets.

FIGS. 7 and 8 respectively show close up views of front and rear connectors shown in FIG. 6. In FIGS. 7 and 8 the comfort padding 80 has been removed. In the embodiments shown in FIGS. 6, 7 and 8, four strap attachment points 2A are provided in the helmet, and four corresponding connectors 50. However, any number of strap attachment points 2A and connectors 50 may be provided, e.g. 2 or 6. Typically the same number of strap attachment points 2A are provided on right and left sides of the helmet 1. These may be front and rear strap attachment points as shown in FIGS. 6, 7 and 8, e.g. placed to be located either side of the wearer's ear.

FIG. 9 shows a side view of the connector 50 attached to the helmet 1. Strap 70, strap attachment part 71 and strap attachment point 2A are shown. It can be seen that the strap attachment part 71 and the first attachment part 51 of the connector 50 are attached to the outer shell 2 of the helmet 1 at the strap attachment point 2A. The inner shell 3 is allowed to slide relative to the outer shell 2 as the resilient structures 53 of the connector 50 deform.

The sliding may be assisted by providing a sliding facilitator 4 between the outer surface of the inner shell 3 and the inner surface of the outer shell 2. For example, the sliding facilitator 4 may be a layer of low friction material such as polycarbonate. This low friction layer may be on an inner surface of the outer shell 2, as shown in FIGS. 9 and 10. The sliding facilitator 4, if provided in the form of a layer of low friction material (e.g. polycarbonate) may be attached to the inside surface of the outer shell 2 also at the strap attachment points 2A. For example, as shown in FIG. 9, the sliding facilitator may be fixed between the outer shell 2 and the connector 50 and/or the strap attachment part 71 by a fixing means 60. Accordingly, the sliding facilitator 4 may be provided with corresponding apertures (not shown) through which the fixing means 60 can pass.

The connectors 50 of the present invention will be described in more detail below. Various embodiments of the connector 50 as shown in FIGS. 11 to 22.

The present invention provides a connector 50 for connecting an inner shell 3 and an outer shell 2 of a helmet 1. The connector 50 comprises a first attachment part 51 for attachment to one of the inner shell 3 and the outer shell 2 and a second attachment part 52 for attaching to the other of the inner shell 3 and the outer shell 2. One or more resilient structures 53 extend between the first attachment part 51 and the second attachment part 52 and are configured to connect the first attachment part 51 and the second attachment part 52 so as to allow the first attachment part 51 to move relative to the second attachment 52 as the resilient structures 53 deform.

Each resilient structure 53 may be configured to deform (e.g. by compression/expansion) so as to change (e.g. decrease/increase) the distance between the first attachment part 51 and the second attachment part 52 at the location of the resilient structure. The extension direction of the resilient structures 53 may be perpendicular to a radial direction of the helmet, when the connector is connected to the helmet. The first attachment part 51, the second attachment part 52 and the resilient structures 53 may be configured so as to be bisected by a plane, P, perpendicular to a radial direction, R, of the helmet (i.e. a tangential direction), when the connector 50 is connected to the helmet. The first attachment part 51 and the second attachment part 52 may be configured to move relative to each other substantially in a plane, P, perpendicular to a radial direction, R, of the helmet, when the connector is connected to the helmet.

The first attachment part 51 and the second attachment part 52 may be separated in a direction perpendicular to a radial direction, R, of the helmet, when the connector 50 is connected to the helmet. The separation may be increased/decreased by the relative movement between the first attachment part 51 and the second attachment part 52. The direction of the decrease/increase of the distance between the first attachment part 51 and the second attachment part 52 is configured to correspond to a direction in which sliding occurs between the outer an inner helmet shells 2, 3, i.e. in a direction perpendicular to a radial direction, R, of the helmet (i.e. a tangential direction). This movement is shown by comparison between FIGS. 27 and 29. FIG. 27 shows a connector 50 in a neutral position, whereas FIG. 29 shown the same connector 50 when sliding occurs between the outer an inner helmet shells 2, 3.

The resilient structures 53 of the connector shown in FIGS. 11 to 14 comprise at least one angular portion between the first attachment part 51 and the second attachment part 52, an angle of said angular portion being configured to change to allow relative movement between the first attachment part 51 and the second attachment part 52.

The resilient structures 53 may generally comprise two portions that extend in directions oblique to each other. These two portions may be connected at respective ends to form the angular portion. The angular portion may be a relatively sharp angle, e.g. with two straight sections meeting directly, or may be curved.

Figure 11:
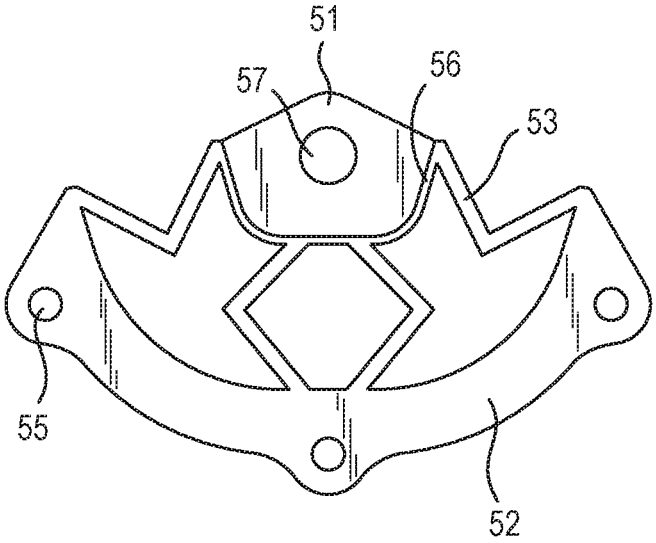
Figure 12:
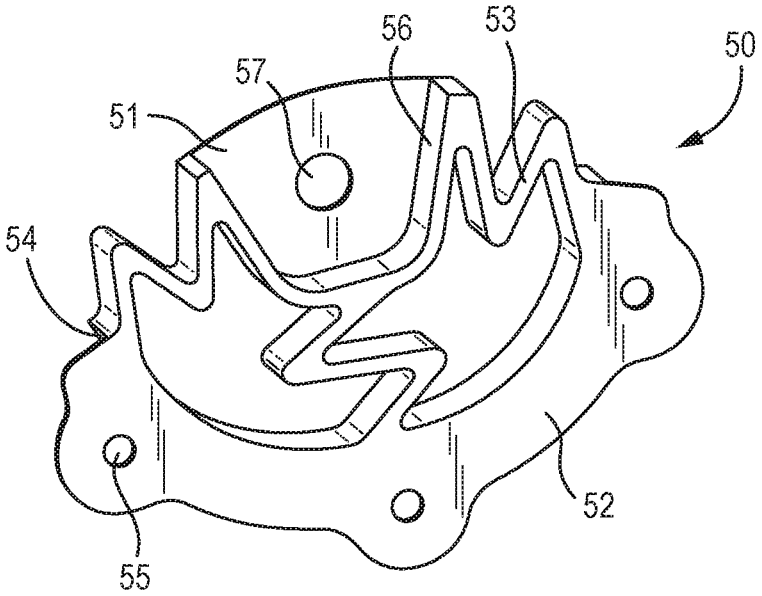

As shown in FIG. 11 the angular portion may be substantially V-shaped. The two ends of the V shape may be connected to the first attachment part 51 and the second attachment part 52 respectively. The ends of the V-shape means the non-connected ends of the two straight sections forming the V-shape. Substantially, V-shaped could apply to the sharp angle or curve described above, e.g. it also describes a U-shape.

Figure 13:
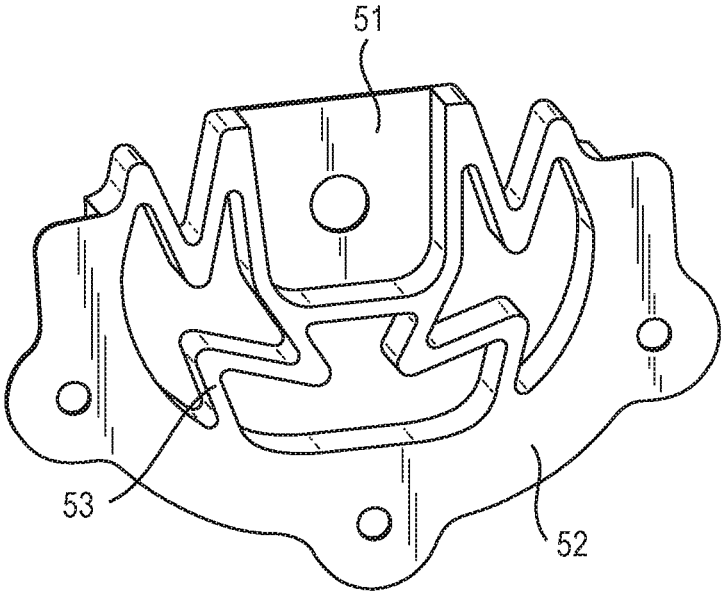
Figure 14:
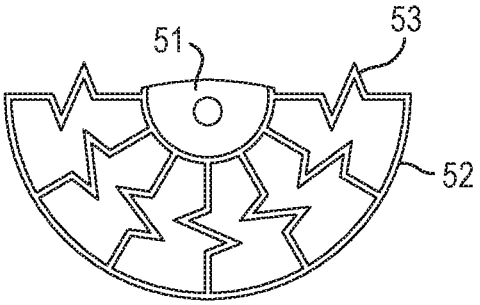

As shown in FIGS. 13 and 14, the angular portion may be substantially Z-shaped, the two ends of the Z shape being connected to the first attachment part 51 and the second attachment part 52 respectively. As shown in FIG. 13 the two ends of the Z shape may be directly connected to the first attachment part 51 and the second attachment part 52.

Alternatively as shown in FIG. 14 the two ends of the Z shape may be connected to the first attachment part 51 and the second attachment part 52 indirectly, for example by further substantially straight sections of the resilient structure 53. In these embodiment, the Z-shape comprises two V-shapes that are connected together. However, any number of V-shapes may be connected in series.

Figure 15:
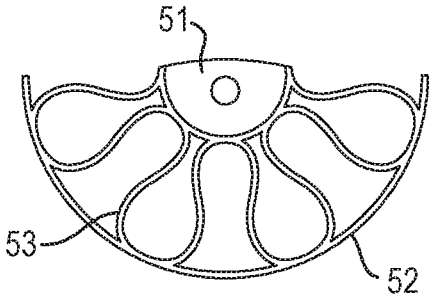

The resilient structures 53 of the connector 50 shown in FIG. 15 comprise at least one inflected portion between the first attachment part 51 and the second attachment part 52. The inflected portion may generally comprise three portions connected in series. The central portion extends in a direction substantially oblique to the directions in which the end two portions extend. In other words, the inflected portions comprise two angled portions, arranged such one of the angled portions forms an interior angle with respect to the central portion and the other form an exterior angle. That is, the inflected portion comprises two bends, in opposite directions.

An inflection amount of said inflected portion may be configured to change to allow relative movement between the first attachment part 51 and the second attachment part 52. Here a change in inflection amount means the inflected portion compresses or expands accordingly, e.g. the angles between the end portions and the central portion of the inflected portion change. The infected portion may be substantially S-shaped. The two ends of the S shape may be connected to a first attachment part 51 and the second attachment part 52 respectively.

Figure 16:
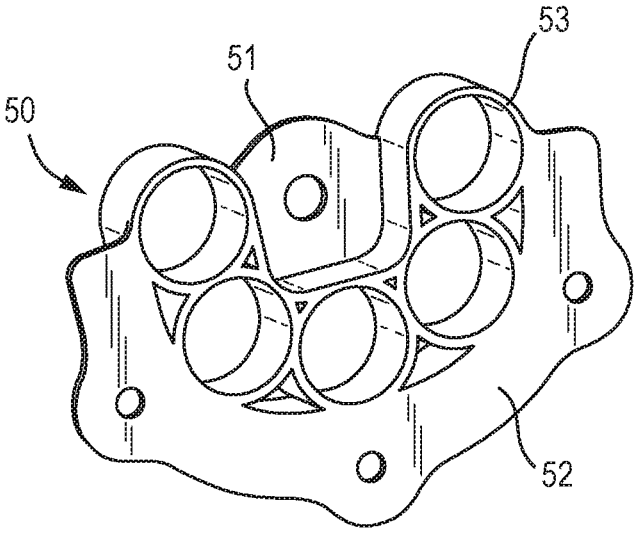

The resilient structures 53 of the connector 50 can comprise at least one loop-like portion. Preferably, as shown in FIG. 16 the loop-like portions can comprise at least one loop, ring or elliptical portion (when in an undeformed state) between the first attachment part 51 and the second attachment part 52. The shape of the loop-like portion may be configured to change to allow relative movement between the first attachment part 51 and the second attachment part 52. Two opposing sides of the loop-like portion may be connected to the first attachment part and the second attachment part respectively. The changing shape of the elliptical portion may mean a change in the eccentricity of the ellipse, for example from circular to non-circular, or may mean the ellipse is deformed in some other way, into a non-elliptical shape. The loop-like portions may be compressed or expanded accordingly, in one or more directions.

Figure 17:
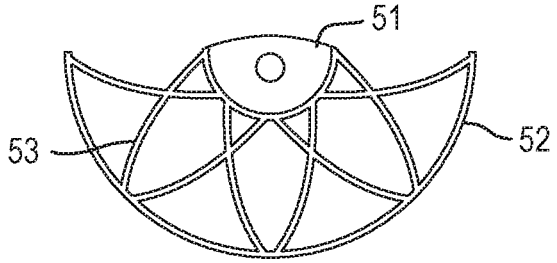
Figure 18:
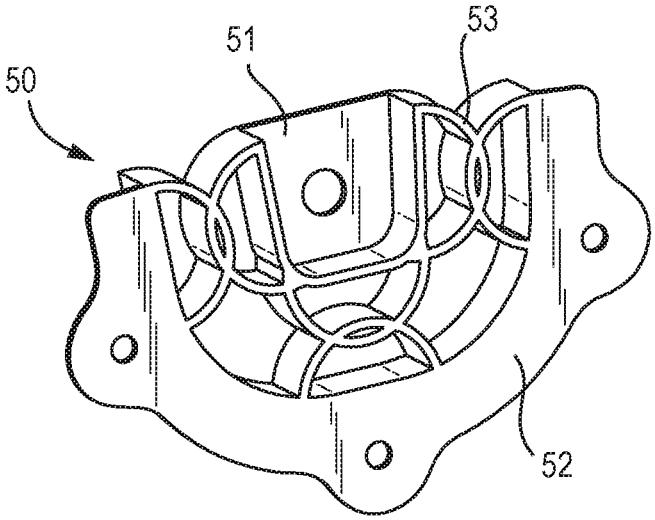

The resilient structures 53 shown in FIGS. 17 and 18 comprises at least two intersecting parts between the first attachment part 51 and the second attachment part 52. The intersecting parts may cross at a point of intersection. The angle at which the two intersecting parts intersect may be configured to change to allow relative movement between the first attachment part 51 and the second attachment part 52. The intersecting parts may intersect to form a substantially X-shaped portion. A first two ends of the X shape may be connected to the first attachment part 51 and a second two ends of the X shape may be connected to the second attachment part 52.

As shown in FIG. 17, the intersecting parts may intersect at a single intersection point. In this embodiment, the intersecting parts are formed from two curved portions, in this case arcs. However, these portions may alternatively be straight.

Alternatively, as shown in FIG. 18 the intersecting parts intersect at more than one intersecting point, e.g. two points as shown. In this embodiment the two intersecting portions are two curved portion, e.g., arcs, curving in opposite directions so as to form two overlapping U-shapes, one U-shape facing in one direction, the other U-shape facing substantially the opposite directions.

Alternatively, the intersecting parts may intersect to form a substantially Y-shaped portion. Two ends of the Y-shape may be connected to one of the first attachment part 51 and the second attachment part 52 and third end of the Y-shape may be connected to the other of the first attachment part 51 and the second attachment part 52.

Figure 19:
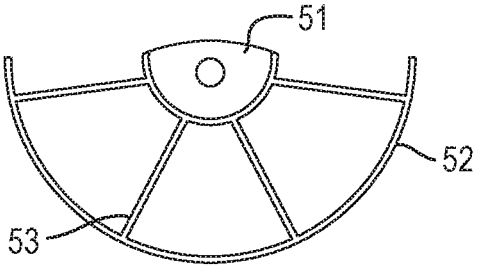

As shown in FIG. 19, the resilient structures 53 may comprise at least one straight portion between the first attachment part 51 and the second attachment part 52, the straight portion being configured to bend to allow relative movement between the first attachment part 51 and the second attachment part 52. The straight portions may extend substantially radially between the attachment parts 51, 52 or obliquely to a radial direction. In each of the above embodiments, the specific shapes of the resilient structures described may be formed in a plane that encompasses the extension direction of the resilient structures 53. However, the connectors 50 are not necessarily flat, they may be curved e.g. formed to follow a curvature of the inner and/or outer shells 3, 2 of the helmet 1. In that case, the specific shapes above, may be formed in a curved surface that encompasses the extension directions of the resilient structures 53.

In the case of multiple resilient structured 53 being provided for a given connector 50, different resilient structures 53 may have different resiliencies. In other words, the stiffness of the resilient structures 53 may be different from one another so as to provide different spring forces.

Providing different stiffnesses between resilient structures 53 allows greater control of the relative movement of the helmet shells 2, 3. For example, selecting the stiffnesses appropriately may allow more freedom of movement in one direction than another.

Alternatively, stiffnesses may be selected in order to provide even resilience in all directions. For example, the embodiment shown in FIGS. 20 and 21 has three resilient structures 53, two of those being on opposite sides of the connector 50, therefore the stiffness in the side-to-side direction of the Figures would be approximately twice as great as the stiffness in the up-to-down direction, if each resilient structure 53 had the same stiffness. Therefore reducing the stiffness of the two resilient structures at the sides by about half would result in a more even resilience of the connector 50 as a whole.

Figure 20:
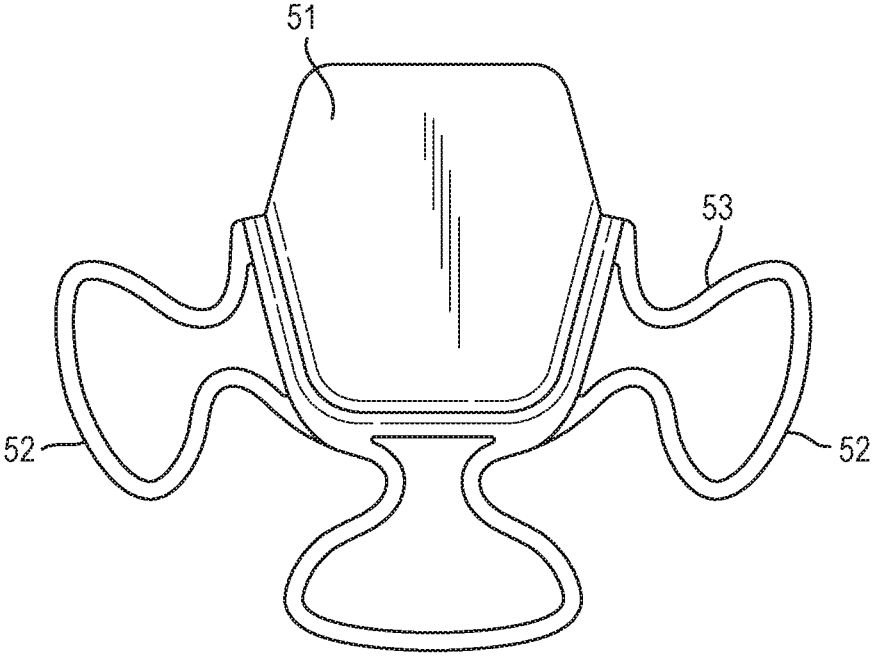

There are many different ways that the stiffness of the resilient structures 53 can be controlled. For example, different materials with different stiffnesses could be used to form the resilient structures 53. The resilient structures 53 may have different shapes (e.g. one of those described above), different lengths, different thicknesses or different widths for example. The resilient structures 53 may include apertures, notches or other configurations in which material is removed from the resilient structures 53 to reduce the stiffness. FIGS. 19 and 20, show resilient structures having different thicknesses (i.e. in the direction parallel to the thickness direction of the inner shell 3). The two resilient structures 53 on opposite sides of the connector 50 are thinner than the central resilient structure 53.

Referring again to FIG. 9, it can be seen that the first attachment part 51 and second attachment part 52 of the connector 50 may be respectively configured to be fixedly attached to one or other of the inner shell 3 and outer shell 2, e.g. in a direction substantially orthogonal to a plane (or curved surface) including the extension directions of the one or more resilient structures 53. For example, as shown in FIG. 9, the resilient structures 53 extend substantially parallel to the outer shell 2 and inner shell 3 (substantially in the top-to-bottom direction of the Figure), whereas the first attachment part 51 and second attachment part 52 are connected perpendicularly to the outer shell 2 and the inner shell 3 (in a substantially left-to-right direction of the Figure). Alternatively one or both of the first attachment part 51 and second attachment part 52 of the connector 50 may be configured to be fixedly attached to one or other of the inner shell 3 and outer shell 2 in a direction parallel to the extension direction of the one or more resilient structures 53. For example, such an arrangement is shown in FIGS. 24, 25 and 27 to 29. In particular, the first attachment part 51 is attached to the outer shell 2 in a direction perpendicular to the extension direction of the resilient structures 53 (i.e. a radial direction of the helmet) and the second attachment part 52 is attached to the inner shell 3 in a direction parallel to the extension direction of the resilient structures 53 (i.e. a direction tangential to the surfaces of the inner and outer shells 3, 2).

The second attachment part 52 may comprise a recess 54 configured to accommodate a portion of the inner shell 3 or outer shell 2 to which the second attachment part 52 is to be attached. As shown in FIG. 9 the second attachment part 52 is attached to the inner shell 3. The recess 54 accommodates a portion of the inner shell 3, as shown. In other words, the inner shell 3 fits into the recess 54 of the connector 50.

The recess 54 of the second attachment part 52 may formed by a first wall and an adjacent second wall of the second attachment part 52. The resilient structures 53 may extend from the first wall. The second wall may be perpendicular to the first wall, extending from the first wall in the opposite direction to the resilient structures 53. Optionally a third wall may be provided parallel to and facing the second wall, the recess being the space between all three walls. The first wall may at least partially surround the second wall, and third wall if present. Thus, the recess 56 may be partially enclosed by the first wall of the second attachment part 52, the recess may be surrounded on three out of four sides by the first wall of the second attachment part 51.

The recess 54 of the second attachment part 52 is an optional feature. For example the second attachment part 52 may comprise a first wall from which the resilient structures 53 extend and a second wall perpendicular to the first wall, but no second wall or third walls as described above, therefore no recess 54 is formed, see e.g. FIGS. 14, 15, 17, 19, 20, 22 and 23 (although alternatively each of these embodiments could instead be provided with a recessed second attachment part 52).

Figure 21:
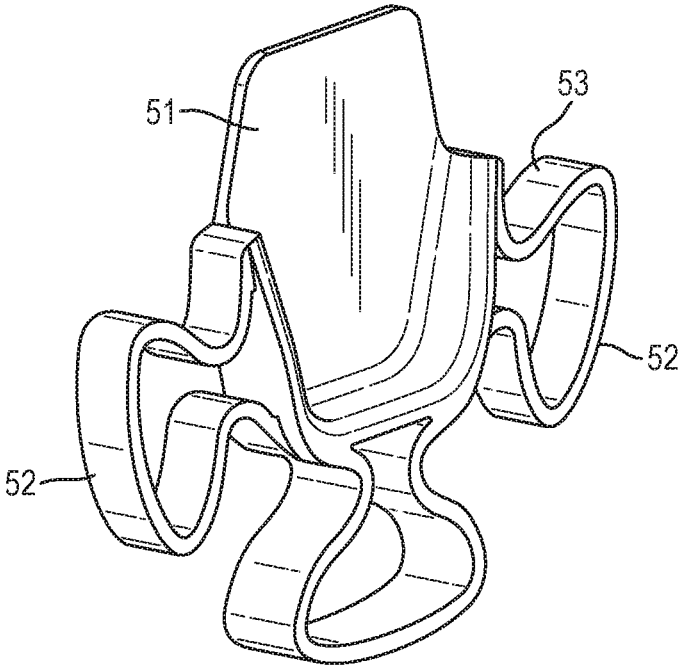

In either case above, i.e. a second attachment part 52 with or without a recess, the second attachment part 52 may be formed as one continuous element or alternatively in several discrete sections, see e.g. FIGS. 20 and 21. In the case of several discrete sections, each of the sections may have a corresponding resilient structure 53. Each separate second attachment part 52 may be connected with two resilient structures 53, e.g. to form a continuous loop-like structure as shown in FIGS. 20 and 21. Each discrete section may or may not comprise a recess 54.

As shown in FIG. 11 for example, the second attachment part 52 may comprise one or more apertures 55 through which fixing means 60 may pass for fixing the second attachment part 52 to the inner shell 3 or outer shell 2 to which the second attachment part 52 is to be attached. FIG. 9 shows fixing means 60 passing through the second attachment part 52 through the apertures 55 to connect the connector 50 to the inner shell 3. As shown in FIG. 11, three apertures 55 may be provided in the second attachment part 52. However any number of apertures 55 may be provided. The recess 54 in the second attachment part 52 may comprises the one or more apertures 55. The apertures 55 may be provided in the recess 54 of the second attachment part 52. The fixing means 60 may be, for example, a bolt, screw or rivet. Apertures 55 may be in the first wall of the second attachment part 52 as described above, the second wall and/or the third wall.

As shown in FIG. 10, the second attachment part 52 may comprise a flexible and/or stretchable portion 52*a*. The flexible and/or stretchable portion 52*a* may be located in the second wall of the second attachment part 52, e.g. between the apertures 55 (or other fixing means) and the first wall. This may allow the second attachment part 52 to stretch, preferably in a direction parallel to the resilient structures 53.

Alternatively, apertures may be provided in the first wall e.g. of non-recessed second attachment part 52 for fixing the connector 50 to the rest of the helmet 1.

Figure 23:
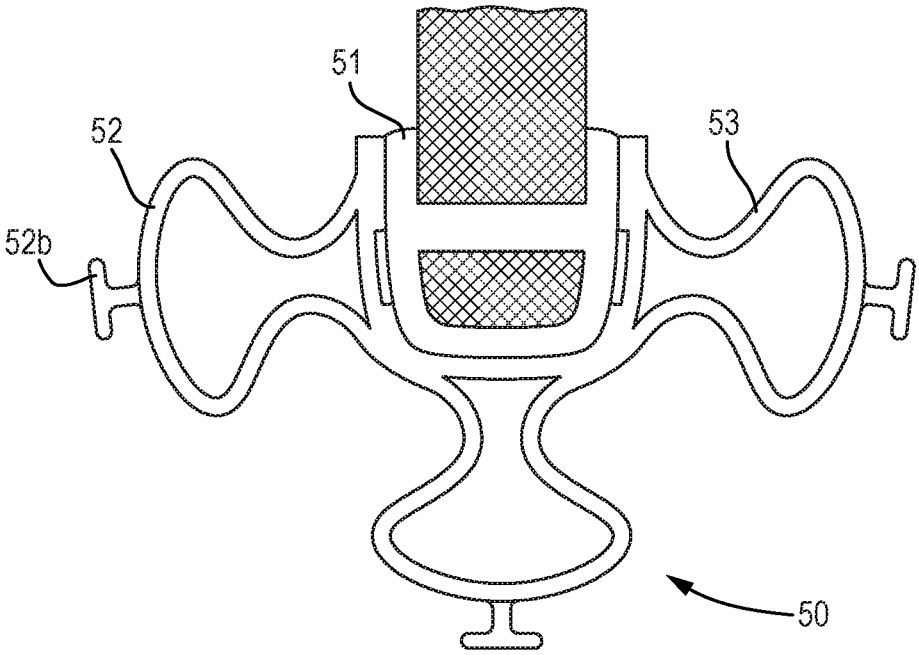

As shown in FIGS. 23 and 24, the second attachment part 52 may comprise a protrusion 52*b* configured to protrude into the inner shell 3 of the helmet 1 for attaching the connector 50 to the inner shell 3. As shown in FIG. 23, the protrusion 52*b* may comprise a substantially straight portion and flanged portion, e.g. at the end of the straight portion. However, as shown in FIG. 24, the flanged end is not necessary. As shown in FIG. 24, the protrusion 52*b* may be tapered, i.e. thinner at a distal end than a proximal end. The protrusion 52*b* and the inner shell 3, a may be mutually configured such that the protrusion 52*b* fits into a channel 3*a* in the inner shell 3, as shown in FIG. 25. Although not shown in the Figures, the channel 3*a* may comprise a portion to accommodate a flanged portion of the protrusion 52*b*. The protrusion 52*b*, may be formed of a resilient material such that the protrusion 52*b* can flex to allow the connector 50 to slide relative to the inner shell 3.

FIGS. 27 to 29 show an embodiment in which the second attachment part is connected to the inner shell 3 by protrusions 52*b*. It can also be seen that the second attachment part 52 of the connectors shown in FIGS. 27 to 29 do not have a recess 54 configured to accommodate a portion of the inner shell 3.

Alternative fixing means 60 may be used to fix the first and/or second attachment parts 51, 52 to the inner and/or outer shells 2, 3 of the helmet 1, e.g. a fixing means 60 comprising an adhesive or a magnet. In this case, no apertures are required in the first and/or second attachment parts 51, 52.

Alternatively, the connectors 50 may be configured to be connected to the inner and/or outer shells 2, 3 of the helmet 1 without the need for fixing means 60, i.e. not fixedly attached. For example, the connectors 50 may be arranged to press fit (interference fit) with the inner and/or outer shells 2, 3 of the helmet 1. For example, appropriate sized and shaped recesses may be provided in the inner and/or outer shells 2, 3 of the helmet 1 to accommodate the connector 50 in a press fit manner. Therefore, the connector is kept in place to the inner and/or outer shells 2, 3 of the helmet 1 by friction between the first and/or second attachment parts 51, 52 and the inner and/or outer shells 2, 3 of the helmet 1.

In other words the first and/or second attachment parts 51, 52 may be engaging parts configured to frictionally engage with the inner and/or outer shells 2, 3 of the helmet 1, i.e. abut the inner and/or outer shells 2, 3 of the helmet 1.

As shown in FIG. 7 for example, the connector 50 may be configured so as to be at least partially embedded in at least one of the inner and outer shells 3, 2, when connected to the helmet. For example, the connector may be configured so as to be located within a recess within at least one of the inner and outer shells 3, 2 (e.g. the inner shell 3 as shown). Further, the connector 50 may be configured so as to be substantially in-line with the one of the inner and outer shells (e.g. the inner shell 3, as shown in FIG. 9).

Preferably, the first attachment part 51 is connected by fixing means 60 to the outer shell 2 and the second attachment part 52 is connected by press fit to the inner shell 3. In such an arrangement, the connectors 50 being at least partially embedded in the inner shell 3 means the inner shell is unable to be removed from within the outer shell 2 despite no fixing means 60 connecting the connector 50 and the inner shell 3.

Figure 22:
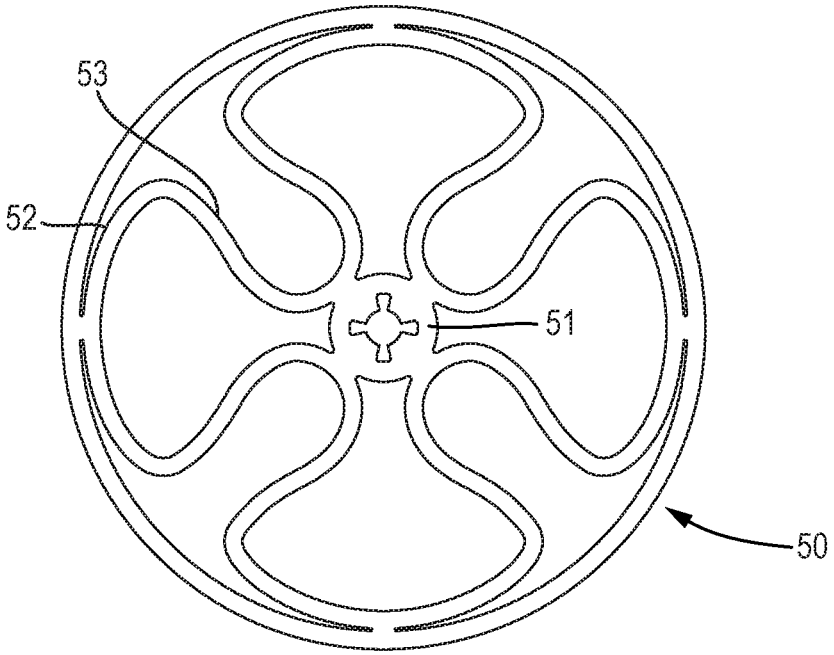

As shown in FIG. 10 for example, the second attachment part 52 may be arranged to at least partially surround the first attachment part 51. For example, the second attachment part 52 may be substantially arc shaped. Such an arrangement is most suitable for connectors 50 to be provided at the edge of the inner shell 3 or outer shell 2. The open side of the arc may be arranged to face away from the edge of the inner shell 3 or outer shell 2. The second attachment part 52 may be arranged to completely surround the first attachment part 51, e.g. as shown in FIG. 22. For example, the second attachment part 52 may form a closed loop, e.g. a circle, around the first attachment part 51. With such an arrangement, the connector 50 can be provided away from an edge of the inner shell 3. For example, the connector 50 may be completely embedded in the inner shell 3, e.g. near the crown of the helmet 1.

The first attachment part 51 may comprise a recess 56 configured to accommodate a strap attachment part 71 for attaching a strap 70 to the helmet 1. As shown in FIG. 9 the strap attachment part 71 of the strap 70 fits into the recess 56 of the first attachment part 51. Thus, the provision of the connector 50 does not require much additional space.

The recess 56 of the first attachment part 51 may formed by a first wall and an adjacent second wall of the first attachment part 51. The resilient structures 53 may extend from the first wall. The second wall may be perpendicular to the first wall, extending from the first wall in the opposite direction to the resilient structures 53. Optionally a third wall may be provided parallel to and facing the second wall, the recess being the space between all three walls.

The first wall of the first attachment part 51 may or may not be of uniform height (dimension in the thickness direction of the helmet shells). For example, as shown in FIG. 20, the height at a particular location on the first wall may correspond to the thickness of the resilient members 53, at that location. For example, the height of the first wall may taper towards the ends of the wall compared to the middle, as shown in FIG. 20.

The first attachment part 51 may comprises one or more apertures 57 through which fixing means 60 may pass for fixing the first attachment part 51 to the inner shell 3 or outer shell 2 to which the first attachment part 51 is to be attached. As shown in FIG. 9 a fixing means 60, e.g. a bolt, passes through the strap attachment part 71 the first attachment part 51 and the outer shell 2 at the strap attachment point 2A to secure the structures together.

Accordingly, the recess 56 of the first attachment part 51 may comprise one or more apertures 57 and the one or more apertures 57 may be further configured such that fixing means 60 may pass through for fixing the strap attachment part 71 to the first attachment part 51. Apertures 55 may be provided in the second wall and/or the third wall of the first attachment part 52 as described above.

Alternatively, or additionally, the strap attachment part 71 may be attached to the first attachment part 51, by other means, such a snap fit configuration. For example, as shown in FIG. 23, the strap attachment part 71 and the first attachment part 51 may comprise mutually engaging structures that snap together to connect the strap attachment part 71 and the first attachment part 51 when the strap attachment part 71 is inserted into the recess 56 of the first attachment part 51.

As shown in FIG. 9 for example, the recess 56 of the first attachment part 51 may face in a direction orthogonal to the extension direction of the one or more resilient structures 53. The recess 54 of the second attachment part 52 may face in a second direction opposite to the first direction. In other words, the recess 56 of the first attachment part 51 and the recess 54 of the second attachment part 52 face in opposite directions.

The first attachment part 51, second attachment part 52 and resilient structures may have a uniform thickness, i.e. in a direction perpendicular to the extension direction of the resilient structures 53. The thickness may be substantially the same thickness as the inner shell 3 of the helmet 1.

As shown in FIG. 26, the first attachment part 51 may not be connected to the strap attachment part 71. The first connecting part 51 may connect to the outer shell 3 or sliding facilitator 4 on the inside surface of the outer shell 3 at a different location to the strap attachment part 71. In such a case the first attachment part 51 may not include a recess 56.

The connectors 50 may be formed from a resilient material, e.g. a polymer, such as rubber or plastic, for example, thermoplastic polyurethane, thermoplastic elastomers or silicone. The connectors 50 may be formed by injection moulding. The entire connector 50 may be formed of a resilient material. Alternatively, the resilient structures 53 may be formed from a resilient material and the first attachment part 51 and/or second attachment part 52 may be formed from a different, e.g. harder, material. In this case, the connector 50 may be formed by co-moulding a resilient material and a harder material.

Variations of the above described embodiment are possible in light of the above teachings. It is to be understood that the invention may be practised otherwise than specifically described herein without departing from the spirit and scope of the invention.

The invention claimed is:

1. A connector for connecting an inner shell and an outer shell of a helmet so as to allow the inner shell and the outer shell to slide relative to each other, the connector comprising:

a first attachment part for attaching to one of the inner shell and the outer shell;

a second attachment part for attaching to the other of the inner shell and the outer shell; and one or more resilient structures extending between the first attachment part and the second attachment part and configured to connect the first attachment part and the second attachment part so as to allow the first attachment part to move relative to the second attachment part as the resilient structures deform;

wherein the first attachment part and the second attachment part are separated in a direction perpendicular to a radial direction of the helmet and the one or more resilient structures extend in the direction perpendicular to the radial direction of the helmet, when the connector is connected to the helmet, such that the first attachment part and the second attachment part can move relative to each other substantially in a plane perpendicular to the radial direction of the helmet, when the connector is connected to the helmet, and wherein the resilient structures comprise, between the first attachment part and the second attachment part, at least one angular portion, an angle of said angular portion being configured to change to allow said relative movement between the first attachment part and the second attachment part, and/or at least one inflected portion, an inflected amount of said inflected portion being configured to change to allow said relative movement between the first attachment part and the second attachment part, and/or at least one loop-like portion being between the first attachment part and the second attachment part, a shape of said loop-like portion being configured to change to allow said relative movement between the first attachment part and the second attachment part.

2. The connector of claim 1, wherein the angular portion is substantially V-shaped, the two ends of the V-shape being connected to the first attachment part and the second attachment part respectively.

3. The connector of claim 1, wherein the angular portion is substantially Z-shaped, the two ends of the Z-shape being connected to the first attachment part and the second attachment part respectively.

4. The connector of claim 1, wherein the inflected portion is substantially S-shaped, the two ends of the S-shape being connected to the first attachment part and the second attachment part respectively.

5. The connector of claim 1, wherein the loop-like portion is substantially elliptical, two opposing sides of the ellipse being connected to the first attachment part and the second attachment part respectively.

6. The connector of claim 1, wherein the angular portion is formed by at least two intersecting parts, the angle at which the two intersecting parts intersect being configured to change to allow relative movement between the first attachment part and the second attachment part.

7. The connector of claim 6, wherein the intersecting parts intersect to form a substantially X-shaped portion, a first two ends of the X-shape being connected to the first attachment part and a second two ends of the X-shape being connected to the second attachment part.

8. The connector of claim 6, wherein the intersecting parts intersect to form a substantially Y-shaped portion, two ends of the Y-shape being connected to one of the first attachment part and the second attachment part and the third end of the Y-shape being connected to the other of the first attachment part and the second attachment part.

9. The connector of claim 1, wherein resilient structures are configured such that the extension direction of the resilient structures is perpendicular to the radial direction of the helmet, when the connector is connected to the helmet.

10. The connector of claim 1, wherein the second attachment part is arranged to at least partially surround the first attachment part.

11. The connector of claim 1, wherein the first attachment part comprises a recess configured to accommodate a strap attachment part for attaching a strap to the helmet.

12. The connector of claim 1, wherein the first attachment part and/or the second attachment part comprises a protrusion configured to protrude into a corresponding channel within the inner and/or outer shell of the helmet, when the connector is connected to the helmet.

13. The connector of claim 1, wherein the connector is configured to press fit into the inner and/or outer shell of the helmet.

14. A helmet, comprising:

an inner shell; and an outer shell, the inner shell and the outer shell being configured to slide relative to each other; and a connector comprising:

a first attachment part for attaching to one of the inner shell and the outer shell;

a second attachment part for attaching to the other of the inner shell and the outer shell; and one or more resilient structures extending between the first attachment part and the second attachment part and connecting the first attachment part and the second attachment part so as to allow the first attachment part to move relative to the second attachment part as the resilient structures deform;

wherein the first attachment part and the second attachment part are separated in a direction perpendicular to a radial direction of the helmet and the one or more resilient structures extend in the direction perpendicular to the radial direction of the helmet, when the connector is connected to the helmet, such that the first attachment part and the second attachment part can move relative to each other substantially in a plane perpendicular to the radial direction of the helmet, when the connector is connected to the helmet, and wherein the resilient structures comprise, between the first attachment part and the second attachment part, at least one angular portion, an angle of said angular portion being configured to change to allow said relative movement between the first attachment part and the second attachment part, and/or at least one inflected portion, an inflected amount of said inflected portion being configured to change to allow said relative movement between the first attachment part and the second attachment, and/or at least one loop-like portion between the first attachment part and the second attachment part, a shape of said loop-like portion being configured to change to allow said relative movement between the first attachment part and the second attachment part.

15. The helmet of claim 14, further comprising a strap attachment point provided on the outer shell for the attachment of a strap;

wherein the first attachment part of the connector is attached to the outer shell at the strap attachment point.

* * * * *